United States Patent [19]

Itoh

[11] Patent Number: 4,590,933

[45] Date of Patent: May 27, 1986

[54] STATIC PRESSURE AUTOMATIC CONTROL DEVICE FOR CLOSED CIRCUIT RESPIRATOR

[75] Inventor: Kazu Itoh, Tokyo, Japan

[73] Assignee: Itoh Seiki Kabushiki Kaisha, Tokyo, Japan

[21] Appl. No.: 685,068

[22] Filed: Dec. 21, 1984

[30] Foreign Application Priority Data

Jan. 13, 1984 [JP] Japan ..... 59-3128[U]

[51] Int. Cl.[4] ..... A62B 7/00

[52] U.S. Cl. ..... 128/205.24

[58] Field of Search ..... 128/201.25, 201.28, 128/205.24, 205.27, 206.15, 207.12, 205.17, 205.26

[56] References Cited

U.S. PATENT DOCUMENTS 3,129,707 4/1964 Becker et al. ..... 128/205.24
3,200,818 8/1965 Johannisson ..... 128/205.17
3,366,108 1/1968 Blackburn et al. ..... 128/205.24
4,154,234 5/1979 Baker ..... 128/205.17

FOREIGN PATENT DOCUMENTS 574701 3/1958 Italy .

*Primary Examiner*—William E. Kamm
*Attorney, Agent, or Firm*—Diller, Ramik & Wight

[57] ABSTRACT

A static pressure automatic control device for respirators of closed-circuit type comprises an exhaled air passage which is branched out of an exhalation system of a respirator and a static pressure discharge valve connected in series to this exhaled air passage. A respiratory dynamic pressure generated by exhalation is attenuated due to resistance encountered while the exhaled air is being passed through the exhaled air passage and substantially the static pressure only is applied to the discharge valve. When the static pressure exceeds a predetermined value, the discharge valve opens to let out a part of gas and thereby decreases the static pressure to the predetermined value.

2 Claims, 2 Drawing Figures

STATIC PRESSURE AUTOMATIC CONTROL DEVICE FOR CLOSED CIRCUIT RESPIRATOR

BACKGROUND OF THE INVENTION

This invention relates to a static pressure automatic control device capable of preventing excessive increase of static pressure inside a closed-circuit type respirator and securing the efficacy thereof.

For rescue and fire extinguishing operations in fire, the respirators of compressed air (oxygen) open-circuit type have been widely used. This type of respirators however is uneconomical as the user inhales air (oxygen) contained in a pressurized container but the exhaled air is discharged to outer atmosphere and wasted. They are detrimental in that the serviceable time is quite limited, too. The respirators of closed-circuit type aim to solve these prior-art problems by passing exhaled air into a cleaning agent instead of discharging it to outside, so as to remove carbon dioxide therein by absorption, and automatically supply oxygen to the remaining air in an amount compensating for the amount consumed from the original oxygen amount, and circulate the air for respiration again. This device can withstand a long service time as compared with the compressed air (oxygen) open-circuit type.

FIG. 1 shows a type of the prior art closed-circuit respirator. In the respirator, an inhalation pipe 5 and an exhalation pipe 3 are connected to a mask 1 inhalation valve 2 and exhalation valve 4. The exhaled air which is discharged through the exhalation pipe 3 is passed to a cleaning canister (carbon dioxide removing device) 7 which is filled with an absorbent agent (such as $Ca(OH_2)_6$ to remove carbon dioxide gas, and the cleaned air is passed through an inhalation box 9 housing a bag 8 which communicates to open air, and then returned to the inhlation pipe 5. The bag 8 is made of a thin elastic material and inflates during inhalation and deflates during exhalation. Oxygen is supplied from a compressed oxygen cylinder 10 to the inhalation box 9 via a demand valve 11 in an amount corresponding to the removed carbon dioxide. The respirator is so structured that if the pressure inside the mask 1 increases excessively, air should be let out through an automatic relief valve 12.

The internal pressure in the circulation system of a respirator fluctuates responding to each breathing; i.e. it generally becomes negative pressure at inhalation and positive pressure at exhalation. The range of pressure that a respirator should cover may vary widely depending on breathing conditions but may generally be more than +/−30 mm in water column. The pressure variable by respiration is defined herein as dynamic pressure while the internal pressure which is not directly related to respiration is defined as static pressure. The static pressure within the circulation system of a respirator may increase because of the increase in internal pressure which is induced by the heat generated by chemical reaction in the absorbent agent, excessive discharge of oxygen into the circulating system or a reduction in pressure from a pressurized state to the atmospheric pressure. This sometimes makes the bag 8 deflate beyond the normal deflatable margin as the breathing bag 8 repeatedly inflates and deflates within the inhalation box 9. In such a case, the breathing bag 8 which is generally made of a rubber coated fabric of ca. 0.2 mm thickness tends to be twisted or otherwise deformed beyond restorable extent, which leads to malfunction thereof. The excessive increase of static pressure therefore should be avoided by all means. According to the result of laboratory tests, such increase usually remains within +10 mm in water column. As the fluctuation of static pressure is smaller than that of respiratory dynamic pressure which is ca. more ±30 mm, if the increment of static pressure is attempted to be offset by letting out the pressure via an automatic relief valve 12, the dynamic pressure will also be discharged to outside, leading to excessive working of the pressure reducing device and therefore excessive supply of oxygen.

SUMMARY OF THE INVENTION

This invention aims to obviate such defects encountered in the prior art respirators of closed circuit type and to provide a static pressure automatic control device which can prevent excessive increase of static pressure within a respirator of closed circuit type and can constantly maintain the function of a exhalation bag at normal level, thereby securing desirable function of the closed-circuit type respirator.

In order to attain above mentioned purpose, the static pressure automatic control device according to this invention is provided with an exhaled air passage which is branched out from the exhalation system extending from a mask to a cleaning canister and which has a breathing resistance sufficient to make the respiratory dynamic pressure attenuate. A static pressure discharge valve is provided in series to the branched out exhaled air passage which valve opens to discharge gas from the exhalation system to outside when the static pressure therein exceeds a predetermined value. By this arrangement, while the exhaled air is being passed through said branched out exhaled air passage, the respiratory dynamic pressure thereof is substantially attenuated and the remaining static pressure alone is discharged to outside.

BRIEF DESCRIPTION OF THE DRAWING

In the attached drawing.

DESCRIPTION OF A PREFERRED EMBODIMENT

An embodiment according to this invention will now be described referring to the attached drawing.

Figure 2:
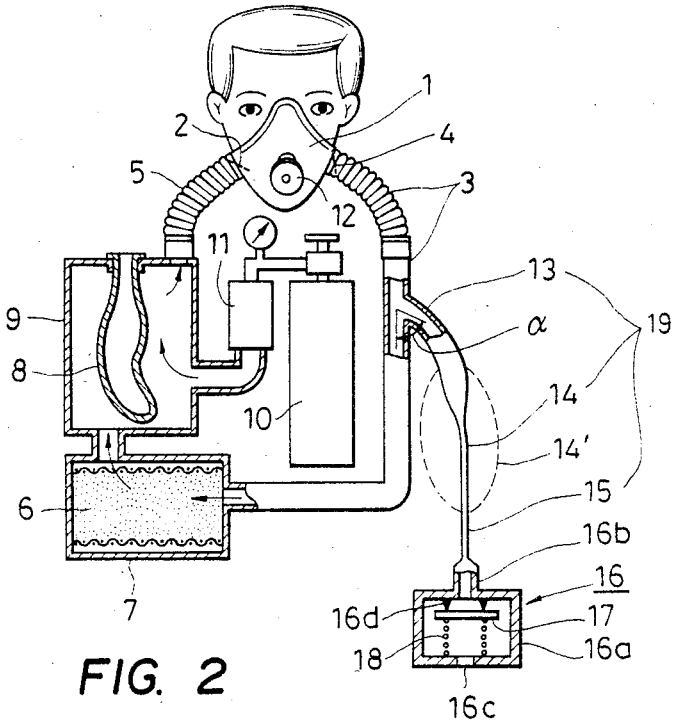

FIG. 2 shows an embodiment of the respirator of closed-circuit type according to this invention which partially uses the structure described in the Japanese Patent Preliminary Publication No. 59-111769 filed by this Applicant.

Figure 1:
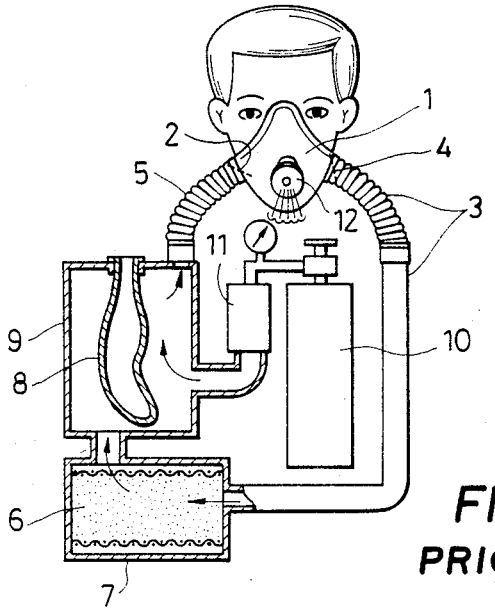
FIG. 1 PRIOR ART
FIG. 1 shows a prior art respirator of closed-circuit type while FIG. 2 an embodiment according to this invention.

The device of this Preliminary Publication No. 59-111769 is directed to alleviate a peak dynamic pressure within the system which tends to be caused by a deep or rapid breathing and prevent excessive supply of oxygen which will be otherwise caused by excessive function of the automatic relief valve 12 by branching out a pipe 13 from the exhalation system extending from a mask 1 to a cleaning canister 7 and providing an elastic and restorable bag (which is referred to as an exhalation bag hereinafter) 14 at the tip thereof, so that the exhalation bag inflates and deflates after a while corresponding to a breathing. In this embodiment, the pipe 13 and the exhalation bag 14 are utilized as a part of the branched out exhaled air passage. The same number denotes the same components in the embodiment in FIG. 2 as in FIG. 1.

As described above, the branched out pipe 13 is connected to the exhalation pipe 3 and the exhalation bag 14 is connected thereto on the tip thereof. The pipe 13 is connected to the exhalation pipe 3 preferably at an acute angle $\alpha$ so as to smoothly branch out the current of the exhaled air within the bag 14 from pipe 3. The bag 14 is structured with an elastic bag having slight restorability (for instance, one similar to rubber bags used for anethesia). The bag in its original form contracts itself as shown in solid line 14, but when it is inflated with gas by a rapid or deep breathing, it expands to the form indicated by dotted line 14', and when the inflow of gas is suspended, it is restored to the original form due to its elasticity to thereby force the gas inside the bag to circulate again the system via the pipe 13.

An opening is formed at the tip end of the bag 14. A capillary tube 15 of extremely small diameter is connected to the opening. The length and the inner diameter of the tube 15 should be determined according to required attenuation in dynamic pressure. The exhaled air passage 19 is comprised of the branched out pipe 13, the bag 14 and the capillary tube 15. On the tip end of the capillary tube 15 is connected a static pressure discharge valve 16. A connecting end portion **16*b* is formed on one side of a case 16*a* of the valve 16 to communicate to the capillary tube 15 while a hole 16*c* is bored on the other side to communicate to outer atmosphere. A valve seat 16*d* is formed on the side of the portion 16*b* in the case 16*a* and a valve main body 17 is seated upon the valve seat 16*d* being urged by a spring 18. The spring force of the spring 18 is set so that when a pressure applied on the valve main body 17 exceeds a predetermined value, the valve body 17 is allowed to be pushed down to separate from the valve seat 16*d***.

The operation of the above described embodiment of the invention will now be described.

The respiration dynamic pressure which is generated by breathing in exhalation system attenuates due to the resistance encountered while the exhaled air is being passed through the branched out exhaled air passage 19 comprising the pipe 3, the pipe 13, the bag 14 and the capillary tube 15. As a result, substantially only static pressure is applied onto the valve body 17 of the static discharge valve 16. When this static pressure exceeds a predetermined value, the valve body 17 overcomes the spring pressure of the spring 18 to move away from the valve seat so that a part of the gas inside the exhalation system is discharged to outside via the hole **16*c* of the valve 16. When the static pressure goes down below the predetermined value, the valve 16** closes.

As will be apparent from the foregoing description, in the pressure existing within the exhalation system, the respiratory dynamic pressure component which is generated by breathing is substantially attenuated and removed so that substantially static pressure component alone is applied to the static pressure discharge valve. It is capable therefore of discharging the static pressure component alone to outside to thereby prevent excessive increase in static pressure as well as of maintaining the function of the breathing bag 8 at normal condition. The device can therefore prevent excessive increase of the oxygen concentration within the inhaled air. The result of an experiment shows that the device can maintain the concentration of oxygen at or below 40%.

Although the branched out exhaled air passage 19 is comprised of the branched out pipe 13, the bag 14, and the capillary tube 15 in the above embodiment, the passage is not limited to this construction. For instance, a capillary and long tube may be branched out from the pipe 3 in the form of a coil to form an exhaled air passage. Any suitable form may be adapted so long as the tube is provided with a resistance sufficient to attenuate the respiratory dynamic pressure either before or after the exhaled air passes through the static pressure discharge valve 16. The static pressure discharge valve 16 is not limited to the one shown in FIG. 2 but may be of any construction so long as it can be opened with a pressure exceeding the predetermined value to let out the gas.

What is claimed is:

1. A static pressure automatic control device for respirators of closed-circuit type comprising an exhalation system including a mask and a cleaning cannister for attenuating respiratory dynamic pressure, and exhaled air passage branched out of said exhalation system extending from said mask to said cleaning cannister, a static pressure discharge valve means connected to said exhaled air passge for opening when the static pressure within said exhaled passage has exceeded a preset value to let out the gas inside the system said exhaled air passage being a pipe, a bag made of an elastic material connected to said pipe, and a tube of an inner diameter which is smaller than that of said pipe connected to said bag.

2. A static pressure automatic control device as defined in claim 1 wherein said static pressure discharge valve means comprises a case, a connecting end portion provided on said case for communicating the inside of said case with said exhaled air passage, a discharge hole formed in said case for letting out gas, a valve seat provided in the vicinity of said connecting end portion on the inside of said case, a valve main body urged by a spring to be seated on said valve seat, means for adjusting the force of said spring so that the static pressure of a magnitude exceeding the preset value causes said valve main body to move away from said valve seat against the force of said spring.

* * * * *